US010737401B1

(12) United States Patent
Coves et al.

(10) Patent No.: US 10,737,401 B1
(45) Date of Patent: Aug. 11, 2020

(54) SWITCHBLADE

(71) Applicants: Bastien Coves, Champions Gate, FL (US); Andrew Scott Mandeville, Candler, NC (US); Anthony Louis Marfione, Fletcher, NC (US)

(72) Inventors: Bastien Coves, Champions Gate, FL (US); Andrew Scott Mandeville, Candler, NC (US); Anthony Louis Marfione, Fletcher, NC (US)

(73) Assignee: Microtech Knives, Inc., Bradford, PA (US)

( * ) Notice: Subject to any disclaimer, the term of this patent is extended or adjusted under 35 U.S.C. 154(b) by 0 days.

(21) Appl. No.: 16/662,397

(22) Filed: Oct. 24, 2019

(51) Int. Cl.
*B26B 1/04* (2006.01)

(52) U.S. Cl.
CPC ..... *B26B 1/042* (2013.01)

(58) Field of Classification Search
CPC ..... B26B 1/042
USPC ..... 30/159, 160
See application file for complete search history.

(56) References Cited

U.S. PATENT DOCUMENTS 1,056,404 A 3/1913 Lorenzo
1,231,058 A 6/1917 Pansa
2,854,745 A 10/1958 Braverman
3,783,509 A * 1/1974 Lake ..... B26B 1/042 30/161
4,089,112 A 5/1978 Richards
D265,719 S 9/1982 Dowdy
D276,887 S 12/1984 Sakurai
4,523,379 A 6/1985 Osterhout
4,744,146 A 5/1988 Schmidt
4,947,552 A 9/1990 Barnes
5,060,379 A 10/1991 Neely
D347,375 S 5/1994 Sakai
5,502,895 A 4/1996 Lemaire
5,511,311 A 4/1996 Collins
5,617,635 A 4/1997 Berns
D385,173 S 10/1997 McWillis
D387,966 S 12/1997 Horn
D389,389 S 1/1998 Glesser
5,722,168 A * 3/1998 Huang ..... B23D 51/01 30/160
5,819,414 A 10/1998 Marifone
D407,002 S 3/1999 Morton
(Continued)

FOREIGN PATENT DOCUMENTS

DE 10 2006 054 422 B3 * 4/2008
FR 2 732 637 * 10/1996

*Primary Examiner* — Hwei-Siu C Payer
(74) *Attorney, Agent, or Firm* — Steve LeBlanc, LLC

(57) ABSTRACT

A switchblade includes a casing having first and second ends and a cavity. A blade has a cutting edge with a retracted position in which the cutting edge is inside the cavity and a deployed position in which the cutting edge extends outside of the cavity from the first end. A spring is operably connected to the blade to bias the blade to the deployed position. A lock at the first end has a hold position that engages with the blade to prevent movement of the blade with respect to the casing and a release position that permits movement of the blade with respect to the casing. An actuator at the second end extends through at least a portion of the casing. A lever connects the actuator to the lock so that the actuator can reposition the lock between the hold position and the release position.

18 Claims, 6 Drawing Sheets

(56) References Cited

U.S. PATENT DOCUMENTS

| | | | | |
|---|---|---|---|---|
| D407,004 | S | 3/1999 | Hull | |
| 6,085,423 | A | 7/2000 | Marifone | |
| 6,101,724 | A | 8/2000 | Halligan | |
| 6,148,522 | A | 11/2000 | Dobandi | |
| D435,421 | S | 12/2000 | Strider | |
| 6,154,965 | A | 12/2000 | Sakai | |
| D438,443 | S | 3/2001 | Keating | |
| D464,246 | S | 10/2002 | Sloan | |
| D473,917 | S | 4/2003 | Carter, III | |
| D474,669 | S | 5/2003 | Onion | |
| 6,675,484 | B2 * | 1/2004 | McHenry | B26B 1/046 30/161 |
| D488,045 | S | 4/2004 | Onion | |
| D505,057 | S | 5/2005 | Ralph | |
| D510,249 | S | 10/2005 | Ray | |
| 7,086,158 | B1 | 9/2006 | Halpern | |
| 7,246,441 | B1 * | 7/2007 | Collins | B26B 1/042 30/159 |
| 7,305,729 | B2 | 12/2007 | Dehner | |
| 7,305,769 | B2 | 12/2007 | McHenry | |
| D567,055 | S | 4/2008 | Renzi | |
| D578,857 | S | 10/2008 | Yang-Fu | |
| D613,754 | S | 4/2010 | Barcheck | |
| D614,933 | S | 5/2010 | Freeman | |
| 7,797,838 | B2 | 9/2010 | Chu | |
| D636,051 | S | 4/2011 | Freeman | |
| 7,979,990 | B2 | 7/2011 | Hawk et al. | |
| 8,028,419 | B2 | 10/2011 | VanHoy | |
| D677,551 | S | 3/2013 | Pelton | |
| D697,780 | S | 1/2014 | Pelton | |
| 8,671,578 | B1 | 3/2014 | Frazer | |
| D706,107 | S | 6/2014 | Pelton | |
| 8,935,855 | B2 * | 1/2015 | Qiu | B26B 5/00 30/156 |
| D737,110 | S | 8/2015 | Schuft | |
| D743,769 | S | 11/2015 | Glesser | |
| D753,459 | S | 4/2016 | Glesser | |
| D765,217 | S | 8/2016 | Tom | |
| D768,456 | S | 10/2016 | Cheng | |
| D768,458 | S | 10/2016 | Mingyi | |
| D769,694 | S | 10/2016 | Mingyi | |
| 9,573,282 | B1 | 2/2017 | Sheahan | |
| D856,109 | S | 8/2019 | Marfione | |
| D856,775 | S | 8/2019 | Marfione | |
| 2003/0070299 | A1 * | 4/2003 | Frazer | B26B 1/048 30/161 |
| 2005/0044717 | A1 | 3/2005 | Nishihara | |
| 2005/0252010 | A1 | 11/2005 | Freeman | |
| 2006/0143929 | A1 | 7/2006 | Lake | |
| 2007/0204468 | A1 | 9/2007 | Cheng | |
| 2012/0180320 | A1 | 7/2012 | Lo | |
| 2012/0304470 | A1 | 12/2012 | Freeman | |
| 2015/0367520 | A1 | 12/2015 | MacNair | |

* cited by examiner

SWITCHBLADE

FIELD OF THE INVENTION

The present invention generally involves a switchblade. In particular embodiments, the switchblade may be single or double action in either a folding or out-the-front configuration.

BACKGROUND OF THE INVENTION

Pocket knives provide a convenient tool for cutting that may be easily carried by a user for deployment when desired. For some pocket knife designs, two hands are needed to deploy and retract a blade, while other designs include a spring that assists a user to deploy and/or retract the blade using a single hand. Each design balances the convenience and speed of operation with increased risk associated with inadvertent operation.

A switchblade is a particular style of pocket knife that has a folding or sliding blade that automatically deploys when an actuator is operated. For a single action switchblade, a spring may be engaged with the blade, and operation of the actuator releases the blade to allow the spring to automatically deploy the blade. Once deployed, the actuator is released to hold the blade in the deployed position. To retract a single action switchblade, the actuator is again operated to release the blade, and the blade must be manually retracted. For example, a single action switchblade design may include a charging handle that may be manually operated to retract the blade, or the user may manually reposition the blade against the spring to retract the blade. For a double action switchblade, operation of the actuator creates force between the spring to automatically deploy and retract the blade.

As for most pocket knives, switchblades are generally longer than they are wide, and the actuator for the switchblade is typically located on the same end from which the folding or sliding blade deploys. For example, a folding switchblade may include a pivotal connection at one end of the switchblade that allows the folding blade to rotate with respect to the pivotal connection to deploy or retract, and the actuator is typically located on the same end of the switchblade as the pivotal connection. Alternately, a sliding switchblade may have an opening at one end of the switchblade through which the sliding blade moves to deploy or retract, and the actuator is typically located on the same end of the switchblade as the opening.

Locating the actuator on the same end from which the folding or sliding blade deploys may simplify the design and operation of the switchblade; however, some switchblade designs may benefit by locating the actuator on the opposite end from which the folding or sliding blade deploys. For example, some switchblades may include a pocket clip attached to the opposite end of the switchblade from which the folding or sliding blade deploys to facilitate secure storage of the switchblade in a pocket. To operate the switchblade, the user typically grasps the end of the switchblade to which the pocket clip is attached, withdraws the switchblade from the pocket, and repositions the switchblade to depress the actuator located on the opposite end of the switchblade. The additional time required to reposition the switchblade before depressing the actuator creates a tactical disadvantage in the event rapid deployment of the blade is needed.

As a result, the need exists for an improved switchblade design in which the actuator is located on the opposite end of the switchblade from which the folding or sliding blade deploys.

BRIEF DESCRIPTION OF THE INVENTION

Aspects and advantages of the invention are set forth below in the following description, or may be obvious from the description, or may be learned through practice of the invention.

One embodiment of the present invention is a switchblade that includes a casing having a first end opposed to a second end and that defines a cavity. A blade has a cutting edge, and the blade has a retracted position in which the cutting edge is inside the cavity and a deployed position in which the cutting edge extends outside of the cavity from the first end of the casing. A spring is operably connected to the blade to bias the blade to the deployed position. A lock at the first end of the casing has a hold position that engages with the blade to prevent movement of the blade with respect to the casing and a release position that permits movement of the blade with respect to the casing. An actuator at the second end of the casing extends through at least a portion of the casing. A lever connects the actuator to the lock so that the actuator can reposition the lock between the hold position and the release position.

An alternate embodiment of the present invention is a switchblade that includes a casing having a first end opposed to a second end and that defines a cavity. A blade has a cutting edge, and the blade has a retracted position in which the cutting edge is inside the cavity and a deployed position in which the cutting edge extends outside of the cavity from the first end of the casing. A spring is operably connected to the blade to bias the blade to the deployed position. A lock at the first end of the casing has a hold position that engages with the blade to prevent movement of the blade with respect to the casing and a release position that permits movement of the blade with respect to the casing. An actuator extends through at least a portion of the second end of the casing. The actuator is pivotally connected to the lock to reposition the lock between the hold position and the release position.

In yet another embodiment of the present invention, a switchblade includes a first scale and a second scale opposed to the first scale, and the first and second scales define a cavity. A blade has a cutting edge, and the blade has a retracted position in which the cutting edge is inside the cavity and a deployed position in which the cutting edge extends outside of the cavity. A spring is operably connected to the blade to bias the blade to the deployed position. A lock has a hold position that engages with the blade to prevent movement of the blade with respect to the first and second scales and a release position that permits movement of the blade with respect to the first and second scales. An actuator extends through at least a portion of the first scale, and the actuator is pivotally connected to the lock to reposition the lock between the hold position and the release position.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
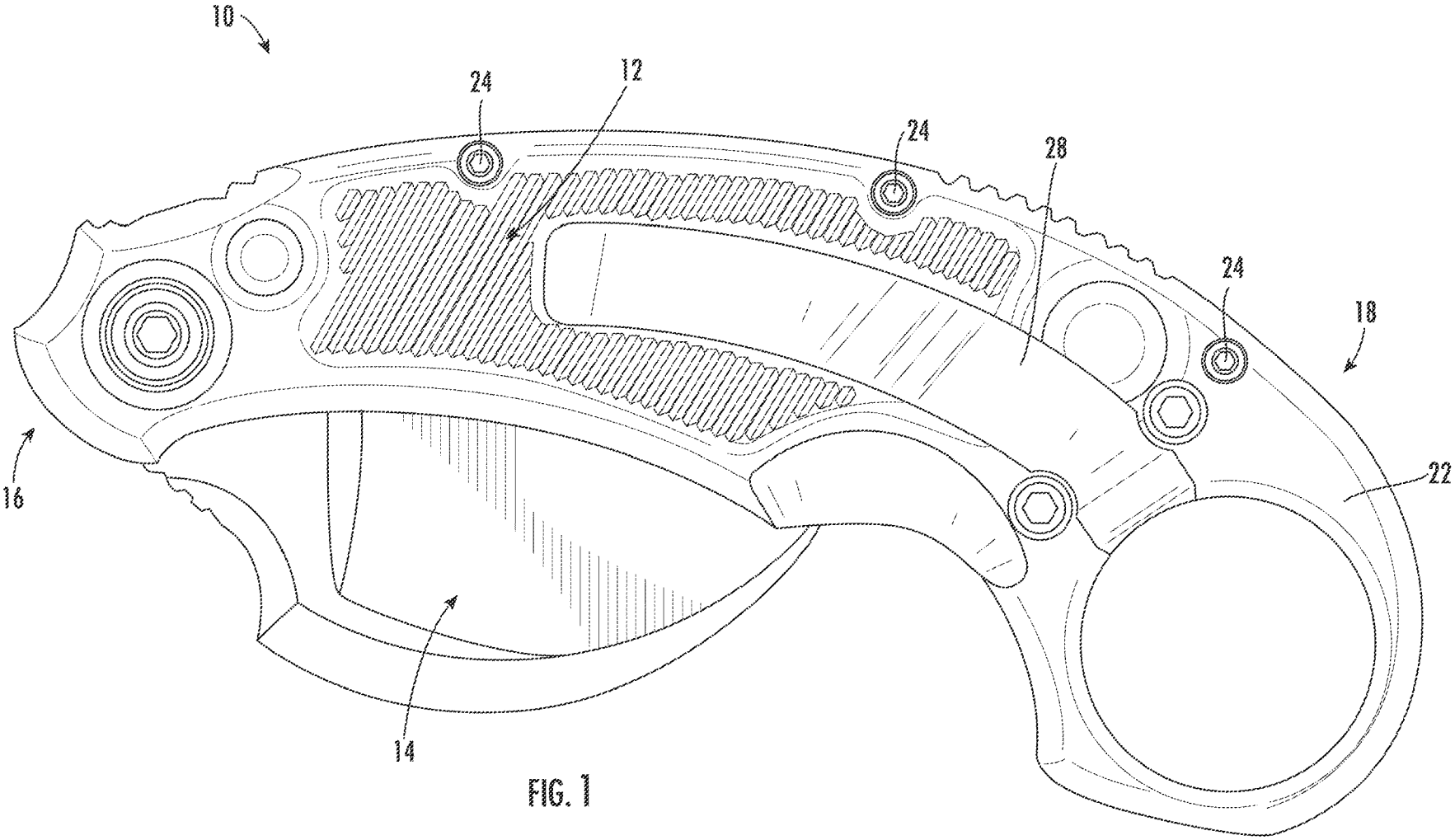
FIG. 1 is a bottom plan view of a switchblade in a retracted position according to one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Embodiments of the present invention include a switchblade with a folding or sliding blade with an actuator located at the opposite end of the switchblade from which the folding or sliding blade deploys. Although various embodiments are illustrated as a folding blade, single action switchblade, one of ordinary skill in the art will readily appreciate that embodiments of the present invention may include an out-the-front switchblade and/or a double action switchblade, and the present invention is not limited to a particular configuration or action unless specifically recited in the claims.

Figure 2:
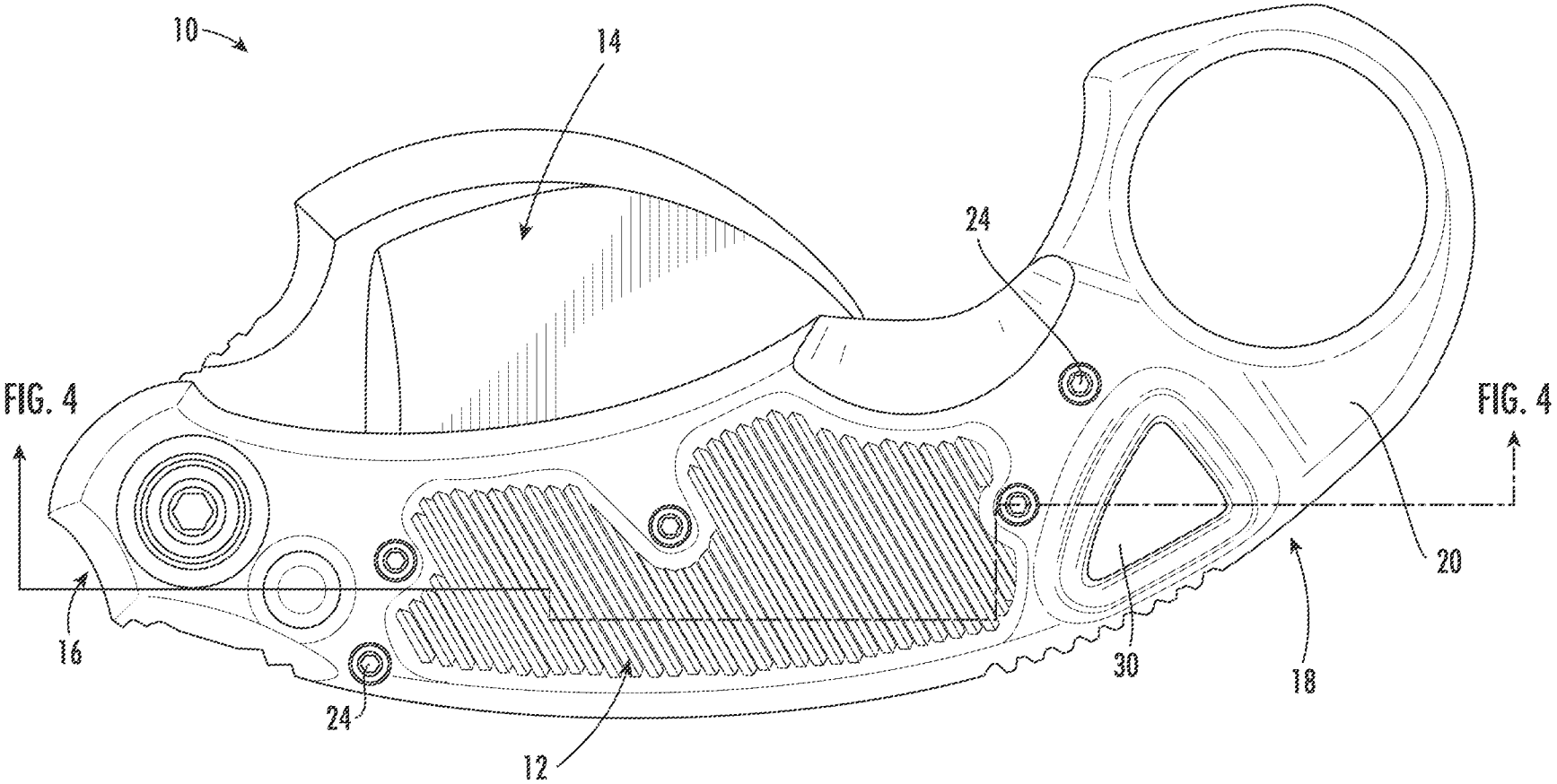
FIG. 2 is a top plan view of the switchblade shown in FIG. 1.

FIG. 1 provides a bottom plan view of a switchblade 10 in a retracted position according to one embodiment of the present invention, and FIG. 2 provides a top plan view of the switchblade 10 shown in FIG. 1. As shown in FIGS. 1 and 2, the switchblade 10 generally includes a casing 12 that houses and supports a blade 14. The casing 12 has a first end 16 opposed to a second end 18. As used herein, the first and second ends 16, 18 refer to the general areas of the casing 12 and not the extreme ends of the casing 12. The casing 12 may include a first scale 20 opposed to a second scale 22 and connected together by screws 24 to define a cavity 26 (shown in FIG. 4) between the first and second scales 20, 22. As shown in FIG. 1, the switchblade 10 may further include a pocket clip 28 connected at the second end 18 of the casing 12. The switchblade 10 further includes an actuator 30 that controls operation the blade 14 between retracted and deployed positions. The actuator 30 is generally located at the second end 18 of the casing 12, and as shown in the particular embodiment shown in FIG. 2, the actuator 30 may extend through at least a portion of the first scale 20 of the casing 12.

Figure 3:
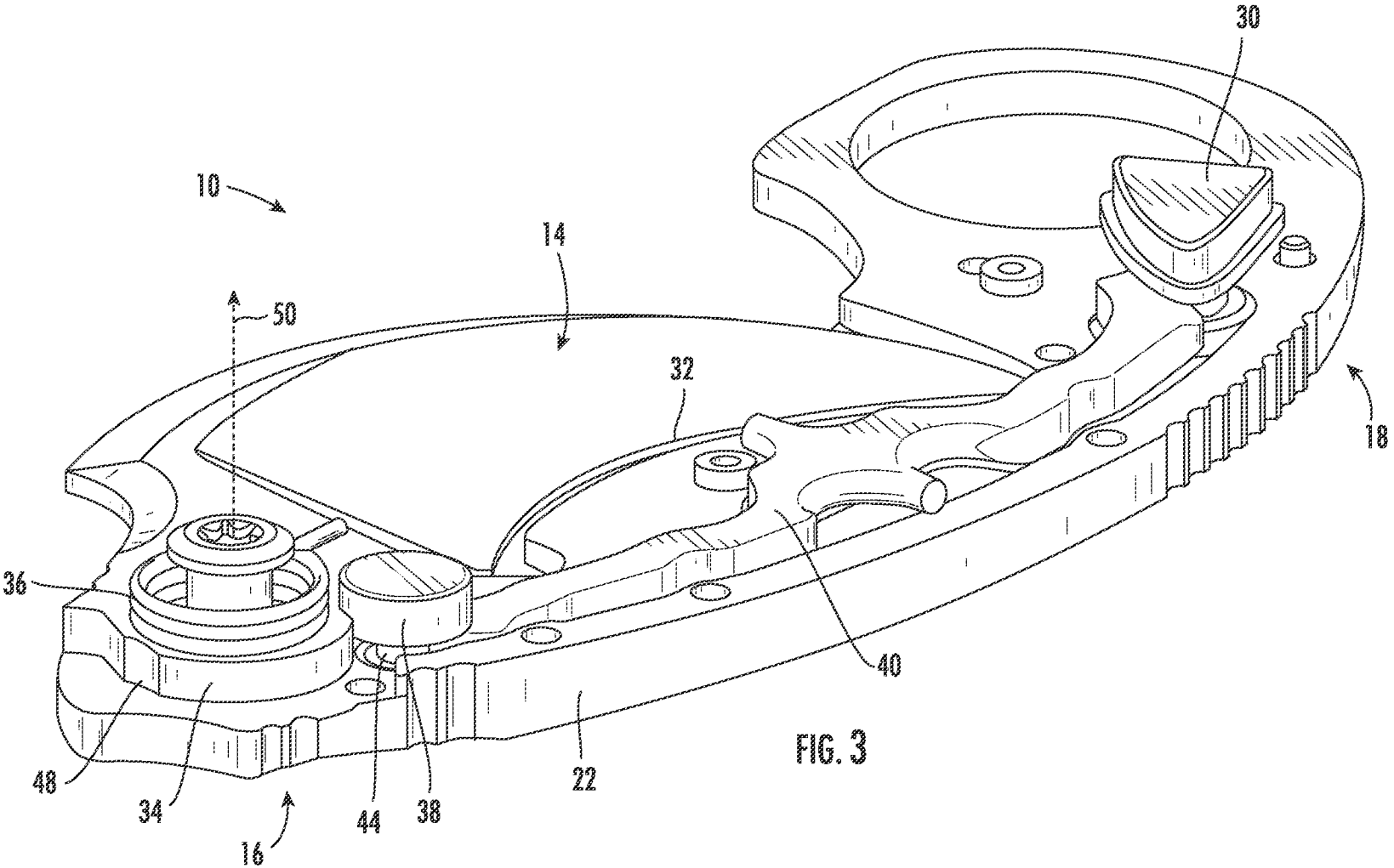
FIG. 3 is a top perspective view of the switchblade shown in FIG. 2 with the top scale removed.
Figure 4:
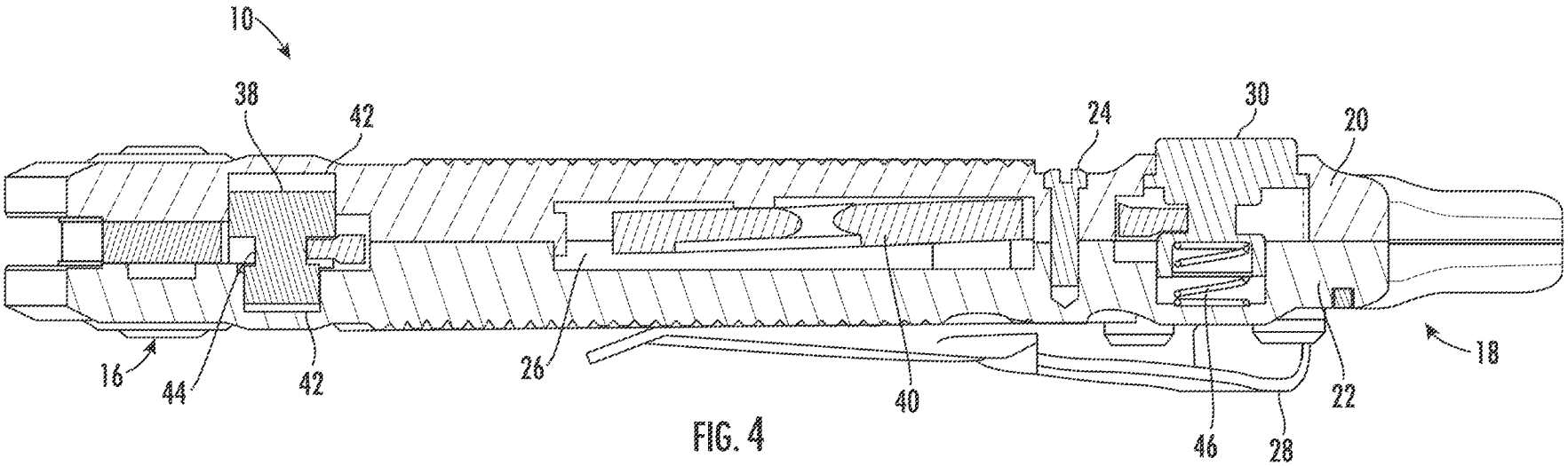
FIG. 4 is a cross-section view of the switchblade shown in FIG. 2 taken along line 4-4.

FIG. 3 provides a top perspective view of the switchblade 10 shown in FIG. 2 with the first scale 20 removed, and FIG. 4 provides a cross-section view of the switchblade 10 shown in FIG. 2 taken along line 4-4. As shown in FIG. 3, the blade 14 generally includes a cutting edge 32 on one or both sides of the blade 14. In particular embodiments, the cutting edge 32 may be curved, straight, and/or serrated. The blade 14 has a retracted position (shown in FIGS. 1-5) in which the cutting edge 32 is inside the cavity 26 and a deployed position (shown in FIG. 6) in which the cutting edge 32 extends outside of the cavity 26 from the first end 16 of the casing 12. In this particular embodiment, the blade 14 includes a tang 34 pivotally connected at the first end 16 of the casing 12. A spring 36 is operably connected to the tang 34 of the blade 14 to bias the blade 14 to the deployed position.

As shown in FIGS. 3 and 4, the switchblade 10 further includes a lock 38 and a lever 40 inside the cavity 26. The lock 38 has a hold position that engages with the blade 14 to prevent movement of the blade 14 with respect to the casing 12 and a release position that permits movement of the blade 14 with respect to the casing 12. For example, the lock 38 may be located in a recess 42 defined by the first and second scales 20, 22 at the first end 16 of the casing 12 and may include a relief 44. The lever 40 pivots with respect to the casing 12 and extends from the lock 38 at the first end 16 of the casing 12 to the actuator 30 at the second end 18 of the casing 12. In this manner, the actuator 30 is connected to the lock 38 by the lever 40, and a spring 46 engaged with the actuator 30 biases the actuator 30 away from the second scale 22. With the actuator 30 biased away from the second scale 22, the lever 40 pivots with respect to the casing 12 to force the lock 38 toward the second scale 22 to the hold position. In the hold position, the lock 38 engages with detents 48 in the tang 34 of the blade 14 when the blade 14 is in the retracted or deployed positions to prevent movement of the blade 14 with respect to the casing 12. When the actuator 30 is depressed toward the second scale 22 to overcome the bias of the spring 46, the lever 40 pivots with respect to the casing 12 to force the lock 38 away from the second scale 22 to the release position. In the release position, the lock 38 disengages from the detents 48 in the tang 34 of the blade 14, and the tang 34 of the blade 14 may pass through the relief 44 in the lock 38 to permit movement of the blade 14 with respect to the casing 12. The relative movement between the blade 14 and the lever 40 is shown most clearly with reference to FIG. 3. As shown in FIG. 3, the tang 34 of the blade 14 pivotally connects the blade 14 to the casing 12 so that the spring 36 may bias the blade 14 to rotate the blade 14 around an axis 50 at the first end 16 of the casing 12. The lever 40 has a first end abutting against the lock 38 and a second end abutting against the actuator 30, wherein the lever 40 moves the lock 38 to the release position upon pressing the actuator 30 in the direction parallel to the axis 50, and the lever 40 moves the lock 38 to the hold position when the pressing is released.

Figure 5:
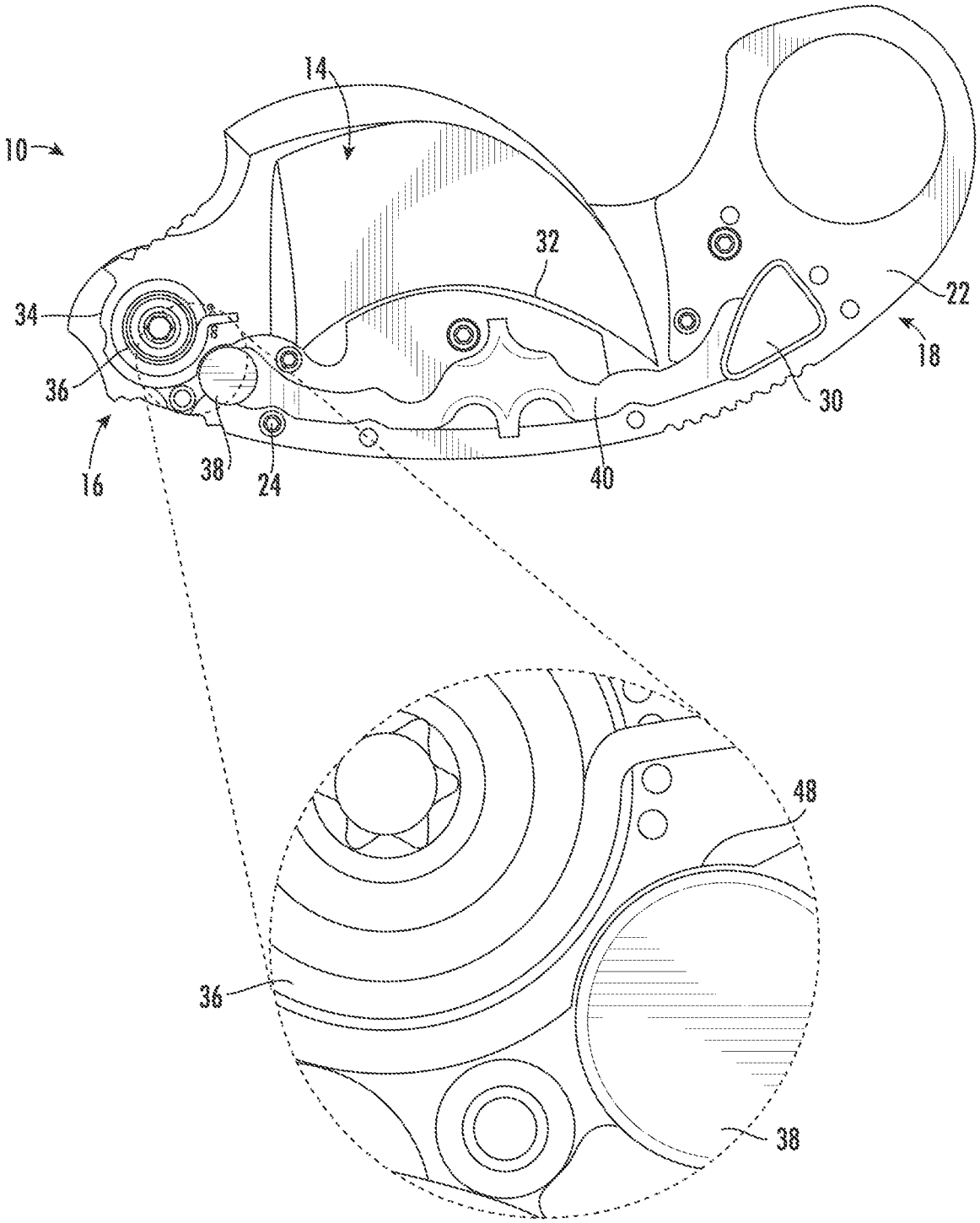
FIG. 5 is a top plan view of the switchblade shown in FIG. 2 with the top scale removed and an enlarged view of the lock in the switchblade.
Figure 6:
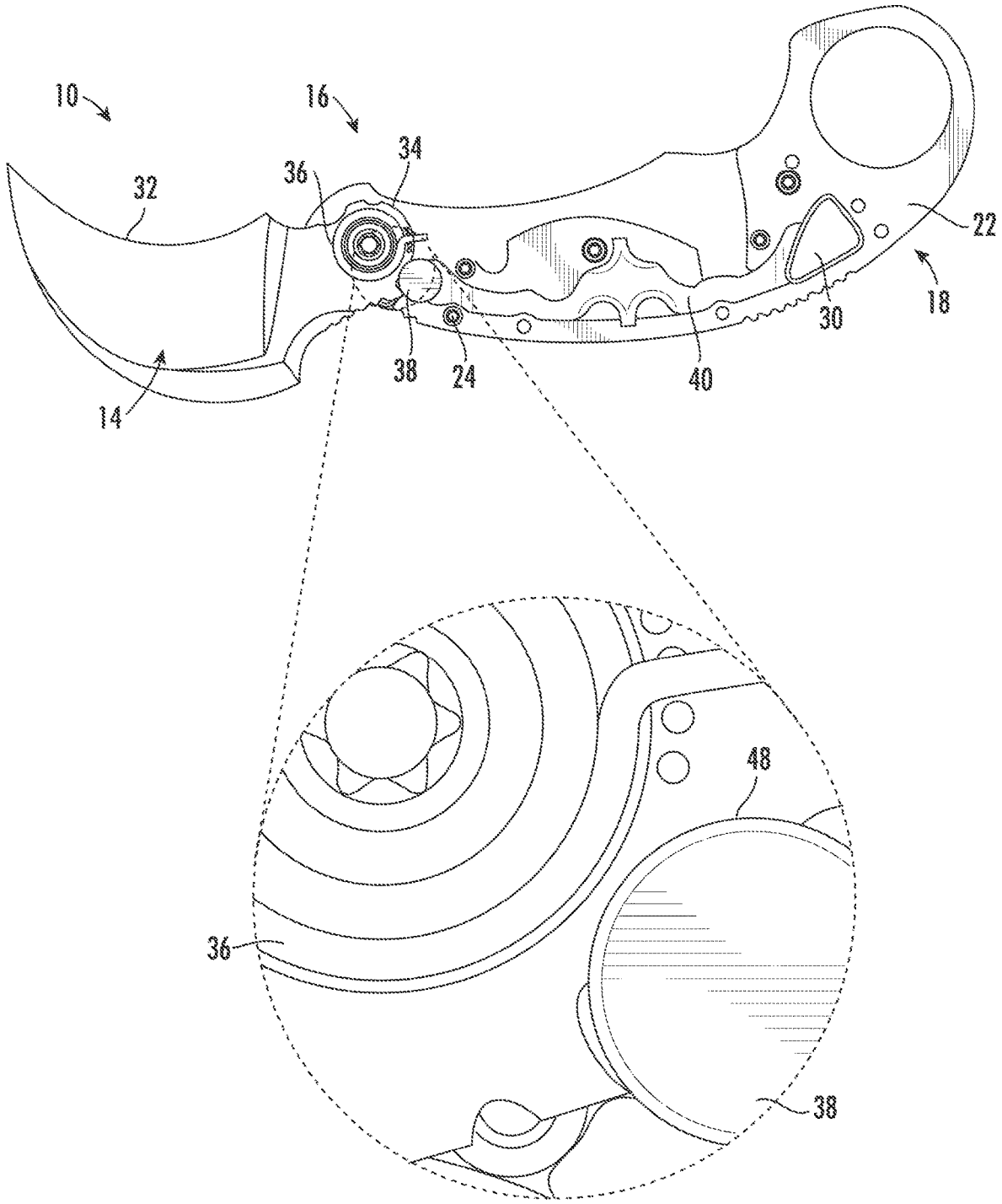
FIG. 6 is a top plan view of the switchblade shown in FIG. 2 in an extended position with the top scale removed and an enlarged view of the lock in the switchblade.

FIG. 5 provides a top plan view of the switchblade 10 shown in FIG. 2 with the first scale 20 removed and an enlarged view of the lock 38, and FIG. 6 provides a top plan view of the switchblade 10 shown in FIG. 2 in an extended position with the first scale 20 removed and an enlarged view of the lock 38. In the retracted position shown in FIG. 5, the cutting edge 32 is inside the cavity 26. The actuator 30 is biased by the spring 46 away from the second scale 22, and the lever 40 forces the lock 38 toward the second scale 22 to the hold position. In the hold position, the lock 38 engages with the detent 48 in the tang 34 of the blade 14 to prevent the spring 36 from rotating the blade 14 with respect to the casing 12.

To deploy the blade 14, the actuator 30 is depressed toward the second scale 22 to overcome the bias of the spring 46, and the lever 40 pivots with respect to the casing 12 to force the lock 38 away from the second scale 22 to the release position. In the release position, the lock 38 disengages from the detent 48 in the tang 34 of the blade 14, and the spring 36 causes the tang 34 of the blade 14 to pass through the relief 44 in the lock 38 to rotate the blade 14 with respect to the casing 12 to the deployed position as shown in FIG. 6. With the blade 14 in the deployed position, the actuator 30 is released, and the spring 46 again biases the actuator 30 away from the second scale 22. With the actuator 30 biased away from the second scale 22, the lever 40 pivots with respect to the casing 12 to again force the lock 38 toward the second scale 22 to the hold position. In the hold position, the lock 38 engages with the detent 48 in the tang 34 of the blade 14 to prevent the blade 14 from rotating with respect to the casing 12.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A switchblade, comprising:

a casing having a first end opposed to a second end thereof, wherein said casing defines a cavity;

a blade having a cutting edge, wherein said blade has a retracted position in which said cutting edge is inside said cavity and a deployed position in which said cutting edge extends outside of said cavity from said first end of said casing;

a spring operably connected to said blade to bias said blade around an axis to said deployed position;

a lock at said first end of said casing, wherein said lock has a hold position that engages with said blade to prevent movement of said blade with respect to said casing and a release position that permits movement of said blade with respect to said casing;

an actuator at said second end of said casing that extends through at least a portion of said casing;

a lever having a first end abutting against said lock and a second end abutting against said actuator, wherein said lever moves said lock to said release position upon pressing said actuator in the direction parallel to said axis, and said lever moves said lock to said hold position when the pressing is released.

2. The switchblade as in claim 1, wherein said blade pivots with respect to said casing when said blade moves from said retracted position to said deployed position.

3. The switchblade as in claim 1, wherein said lock moves in an opposite direction as said actuator when said actuator repositions said lock between said hold position and said release position.

4. The switchblade as in claim 1, wherein said actuator is biased to reposition said lock to said hold position.

5. The switchblade as in claim 1, wherein said lever pivots with respect to said casing.

6. The switchblade as in claim 1, further comprising a pocket clip connected to said second end of said casing.

7. A switchblade, comprising:

a casing having a first end opposed to a second end thereof, wherein said casing defines a cavity;

a blade having a cutting edge, wherein said blade has a retracted position in which said cutting edge is inside said cavity and a deployed position in which said cutting edge extends outside of said cavity from said first end of said casing;

a spring operably connected to said blade to bias said blade around an axis to said deployed position;

a lock at said first end of said casing, wherein said lock has a hold position that engages with said blade to prevent movement of said blade with respect to said casing and a release position that permits movement of said blade with respect to said casing;

an actuator biased outward to extend through at least a portion of said second end of said casing, wherein said actuator is pivotally connected to said lock to reposition said lock between said hold position and said release position;

wherein said actuator moves said lock to said release position upon pressing said actuator in the direction parallel to said axis, and said actuator moves said lock to said hold position when the pressing is released.

8. The switchblade as in claim 7, wherein said blade pivots with respect to said casing when said blade moves from said retracted position to said deployed position.

9. The switchblade as in claim 7, wherein said lock moves in an opposite direction as said actuator when said actuator repositions said lock between said hold position and said release position.

10. The switchblade as in claim 7, wherein said actuator is biased to reposition said lock to said hold position.

11. The switchblade as in claim 7, further comprising a lever that extends from said lock at said first end of said casing to said actuator at said second end of said casing.

12. The switchblade as in claim 7, further comprising a pocket clip connected to said second end of said casing.

13. A switchblade, comprising:

a first scale and a second scale opposed to said first scale, wherein said first and second scales define a cavity;

a blade having a cutting edge, wherein said blade has a retracted position in which said cutting edge is inside said cavity and a deployed position in which said cutting edge extends outside of said cavity;

a spring operably connected to said blade to bias said blade around an axis to said deployed position;

a lock having a hold position that engages with said blade to prevent movement of said blade with respect to said first and second scales and a release position that permits movement of said blade with respect to said first and second scales;

an actuator biased outward to extend through at least a portion of said first scale, wherein said actuator is pivotally connected to said lock to reposition said lock between said hold position and said release position;

wherein said actuator moves said lock to said release position upon pressing said actuator in the direction parallel to said axis, and said actuator moves said lock to said hold position when the pressing is released.

14. The switchblade as in claim 13, wherein said blade pivots with respect to said first and second scales when said blade moves from said retracted position to said deployed position.

15. The switchblade as in claim 13, wherein said lock moves in an opposite direction as said actuator when said actuator repositions said lock between said hold position and said release position.

16. The switchblade as in claim 13, wherein said actuator is biased to reposition said lock to said hold position.

17. The switchblade as in claim 13, further comprising a lever inside said cavity that connects said lock to said actuator.

18. The switchblade as in claim 13, further comprising a pocket clip connected to said second scale.

* * * * *